United States Patent [19]

Rosenbaum

[11] 4,264,231

[45] Apr. 28, 1981

[54] JOINT BETWEEN MAIN BEAM AND CROSS BEAMS IN SUSPENDED CEILING SYSTEM

[75] Inventor: Per Rosenbaum, Woodbine, Md.

[73] Assignee: Roper Corporation, Kankakee, Ill.

[21] Appl. No.: 127,122

[22] Filed: Mar. 4, 1980

[51] Int. Cl.[3] ..... F16B 7/22

[52] U.S. Cl. ..... 403/347; 52/667

[58] Field of Search ..... 403/346, 347, 207, 252; 52/667

[56] References Cited

U.S. PATENT DOCUMENTS

| | | | |
|---|---|---|---|
| 3,193,063 | 7/1965 | Brown et al. | 52/667 |
| 3,501,185 | 3/1970 | Brown et al. | 52/252 |
| 3,606,417 | 9/1971 | Rousey | 52/667 X |
| 3,746,379 | 7/1973 | Sauer | 52/667 X |
| 3,921,363 | 11/1975 | Beynon | 403/347 X |
| 4,043,689 | 8/1977 | Spencer | 52/667 X |
| 4,108,563 | 8/1978 | Brown | 52/667 X |

*Primary Examiner*—Andrew V. Kundrat

*Attorney, Agent, or Firm*—C. Frederick Leydig; Richard L. Voit; David J. Richter

[57] ABSTRACT

A suspended ceiling system including a main beam formed with a vertically extending rectangular window and a pair of cross beams intended to abut the main beam in alignment with one another at the window. The cross beams, which are identical, have at each end a pair of longitudinally extending vertically spaced tongues integral with the web thereof, the tongues being spaced and laterally offset in opposite directions from the plane of the associated web to such degree that the diagonally measured distance between the upper edge of the upper tongue and the lower edge of the lower tongue is equal to the diagonal dimension of the window so that, when the tongues of the mated cross beams are inserted into the window from opposite sides to seated positions, the tongues of the cross beams mutually overlap one another for snug occupation of all four corners of the window opening. To lock the parts in place the lower tongues are each formed with a downwardly extending hook projection which is in interfering engagement with the lower edge, or ledge, of the window, making the cross beams captive against longitudinal withdrawal from their seated positions. The tongues are of substantially the same length, but the upper tongues are relieved along the tip portions of their upper edges to provide initial clearance with respect to the upper edge of the window, thereby to permit the hook projection on the cross beam to be hooked over the ledge of the window as a preliminary to the the movement of the parts into seated condition.

10 Claims, 17 Drawing Figures

JOINT BETWEEN MAIN BEAM AND CROSS BEAMS IN SUSPENDED CEILING SYSTEM

A suspended ceiling system preferably includes a grid formed of metallic main beams, or runners, arranged parallel to one another and which are bridged at intervals by cross beams which intersect the main beams at right angles.

Much attention has been given to the nature of the joint at the region of intersection. The joint should be capable of quick and easy assembly, neat and closely fitted, strong and permanent, yet capable of easy disassembly. Patents showing typical prior structures include Brown et al. U.S. Pat. No. 3,193,063, Brown et al. U.S. Pat. No. 3,501,185, Sauer U.S. Pat. No. 3,746,379, Beynon U.S. Pat. No. 3,921,363 and Brown et al. U.S. Pat. No. 4,108,563. When these structures were first devised they were doubtless considered by their inventors to be the answer to the problem, but such structures have been found to have various operational and economic drawbacks, the alleged inventive features being more theoretical than real, and the search for a truly satisfactory joint for a grid type ceiling system has continued unabated.

It is an object of the present invention to provide a joint for a suspended ceiling system which may be easily and quickly assembled without exercise of judgment or skill on the part of the installer but which is, nonetheless, strong, tight and highly secure.

It is a related object to provide a joint for a ceiling grid which may be easily and cheaply fabricated, which provides a neat and accurate finished result, in which critical dimensions need not be adhered to and in which the parts slide together freely and smoothly with a high degree of uniformity from one joint to the next. In this connection it is an object to provide a joint in which the parts are securely locked in place but in which no reliance is placed upon hooks or detents which depend for their function upon the locally exhibited resilience of the metal.

It is another object of the invention in one of its aspects to provide a joint for a ceiling system which permits easy disassembly by simple reversal of the assembly movements and without necessity for freeing connections which have been sharply detented together.

It is a further object of the invention to provide a joint for a suspended ceiling system which is extremely simple as compared to conventional constructions consisting of a pair of diagonally offset tongues formed at the ends of a cross beam which are inserted into a rectangular window opening in the main beam. It is a more detailed object to provide a joint between a main beam and a pair of mated and abutting cross beams in which torsional reaction forces are applied about the longitudinal axis of each of the cross beams but in which the construction has novel symmetry such that the torsional reaction forces nullify one another so that the cross beams are maintained in a precise coplanar relation.

Other objects and advantages of the invention will become apparent upon reading the attached detailed description and upon reference to the drawings in which.

While the invention has been described in connection with certain preferred embodiments, it will be understood that I do not intend to be limited to the particular embodiments shown but intend, on the contrary, to cover the various alternative and equivalent constructions included within the spirit and scope of the appended claims.

Figure 1:
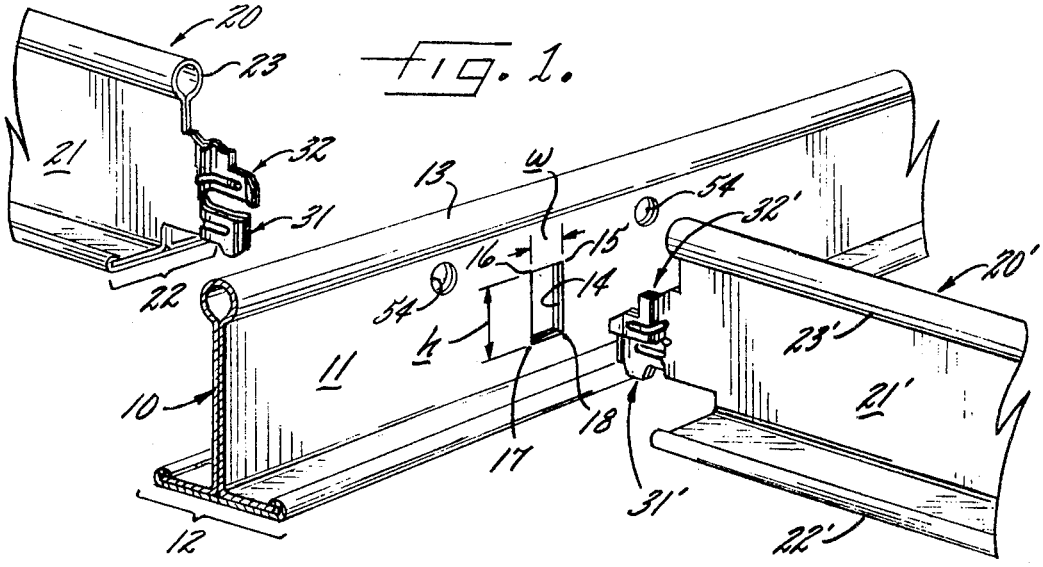
FIG. 1 is a fragmentary view showing the main beam and a pair of cross beams prior to assembly.
Figure 2:
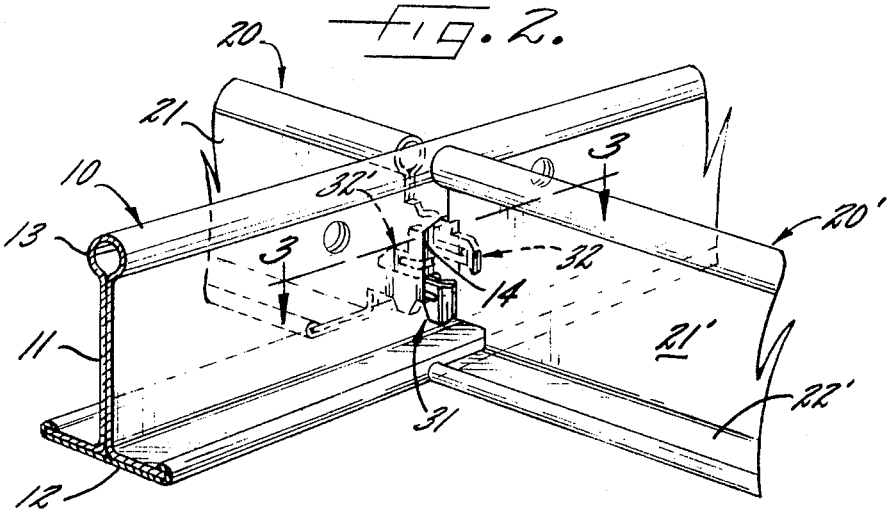
FIG. 2 shows the parts in assembled condition.
Figure 3:
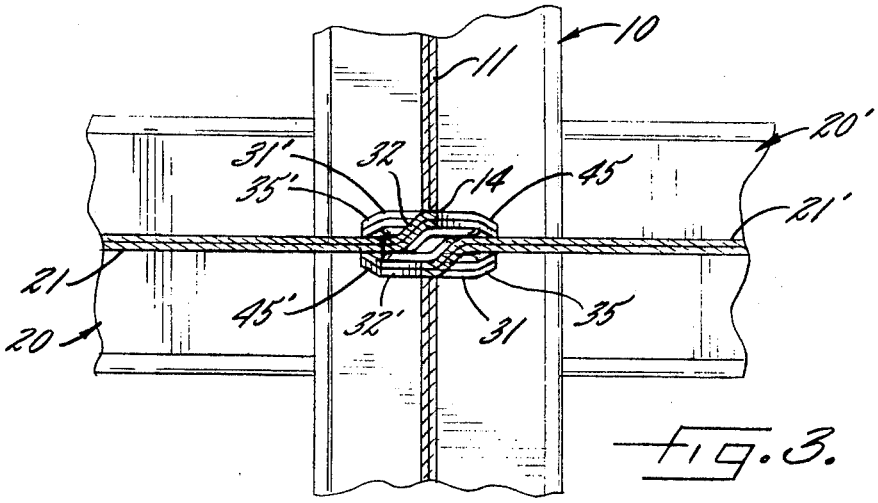
FIG. 3 is a fragmentary horizontal section taken along line 3—3 in FIG. 2.

Turning now to FIG. 1 of the drawings, a main beam, or runner, indicated at 10 includes a central web 11 having a flange 12 in "T" formation extending at right angles along its lower edge, the web being reinforced along its upper edge by a bead 13 of circular cross section. Formed in the web, preferably by punching, is a rectangular vertically-extending window 14 having a pair of upper corners 15, 16 and a pair of lower corners 17, 18, the corners 15, 17 and 16, 18 being diagonally related.

In accordance with the present invention a pair of identical cross beams are provided each having a pair of longitudinally extending vertically spaced tongues which are laterally offset in opposite directions from the plane of the associated web and so dimensioned that when the tongues of the cross beams are inserted into the window from opposite sides to seated positions, the tongues of one of the cross beams, in diagonal positions, mutually overlap the other for snug occupation of all four corners of the window opening.

A typical cross beam, indicated at 20, has a web 21, a lower flange 22 extending at right angles to the web, with the web being topped by a reinforcing bead 23.

Forming an integral extension of the web 21 are a pair of tongues including a lower tongue 31 and an upper tongue 32 slightly spaced from one another in the vertical direction.

Figure 4:
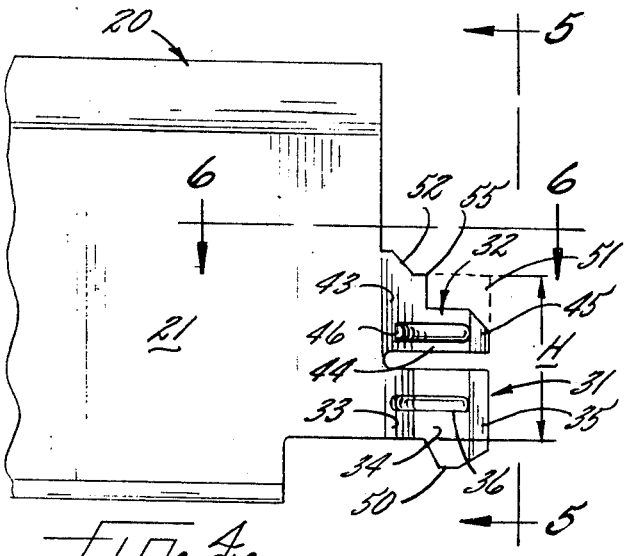
FIG. 4 is an elevational view, somewhat enlarged, showing the end of one of the cross beams.
Figure 5:
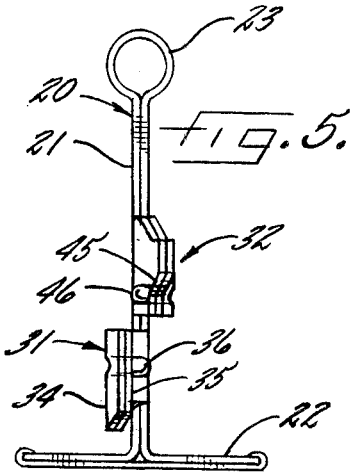
FIG. 5 is an end view looking along line 5—5 of FIG. 4.
Figure 6:
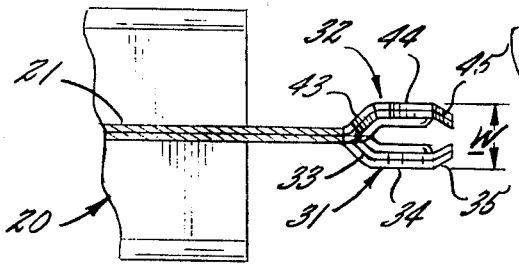
FIG. 6 is a fragmentary cross section taken along line 6—6 in FIG. 4.

Referring first to the lower tongue 31, which is set forth in enlarged form in FIGS. 4, 5 and 6, it will be seen that it consists, in its preferred form, of a first angularly offset portion 33 at its base, a central portion 34 which is parallel to the web 21, and an inwardly bent tip portion 35. The metal forming the tongue is preferably embossed for purposes of increasing rigidity, as indicated at 36. Similarly, upper tongue 32 has an angularly offset base portion 43, a central portion 44 which is parallel to the web and an inwardly bent tip 45 rigidified by an embossment 46. The amount of lateral offset in opposite directions from the plane of the associated web is such as to produce a width dimension W (FIG. 6) which is just slightly in excess of the width w of the window (FIG. 1), thereby to insure a resiliently interfering fit.

The tongues are so spaced, and of such vertical extent, that the height dimension H (FIG. 4) of the two tongues, taken together, corresponds to, and is preferably slightly less than, the height dimension h of the window. The width and height dimensions produce a resultant diagonal dimension D as illustrated, for example, in FIG. 9 in which the tongues occupy all four of the diagonal corner positions in the window.

Figure 8:
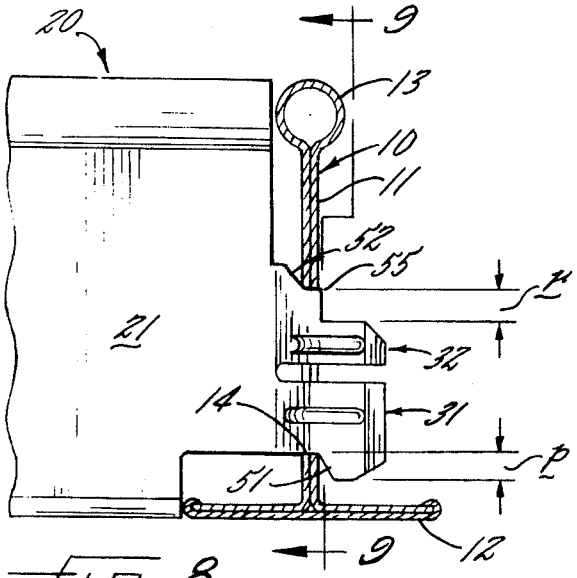
FIG. 8 is a view similar to FIG. 7 but showing the parts in seated condition.

In accordance with one of the aspects of the present invention the lower tongue 31 is formed with a downwardly extending hook projection 50 which is in interfering engagement with the lower edge, or ledge, of the window so that when the cross beam is in seated position it is captive with respect to the main beam against longitudinal withdrawal. In carrying out the invention the two tongues 31, 32 are of substantially the same length measured longitudinally of the cross beam, but the tip portion of the upper tongue is of reduced width in the vertical direction to provide initial clearance with respect to the upper edge of the window to permit the hook projection of the lower tongue to be hooked over the lower edge of the window. Specifically the upper tongue of the cross beam is relieved at the tip of its upper edge by notching or trimming it as the tongue is formed, the relief being indicated at 51 (FIG. 4) bounded by the dot-dash outline. The amount of relief formed in the upper tongue, measured vertically and indicated at r in FIG. 8 is preferably equal to or just slightly less than the hook projection, also measured vertically, and indicated at p in the same figure.

In addition to providing a hook projection 50 on the lower tongue to prevent withdrawal of the cross beam from the main beam, I preferably provide a stop surface on the upper tongue to limit the degree of insertion of the cross beam into the window and to prevent the cross beam from being swung upwardly substantially beyond its normal horizontal position. Such stop surface is indicated at 52 in FIGS. 4, 7 and 8.

It is one of the features of the invention that the two cross beams which are in mated and abutting relation to one another at the window are of identical construction. Consequently, the same reference numerals have been employed on the right-hand cross beam as on the left, to indicate similar elements, with the addition of a prime.

Figure 7:
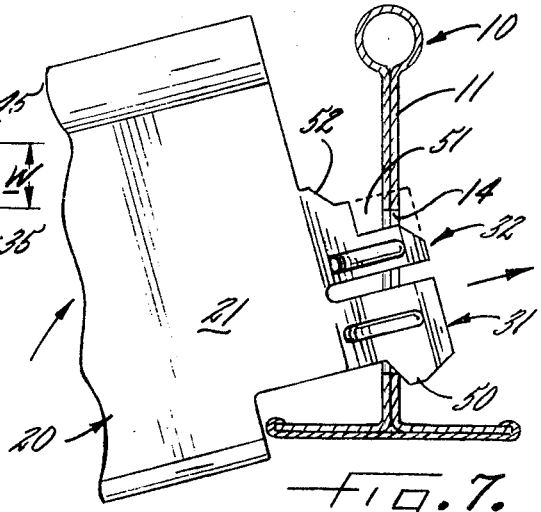
FIG. 7 is a fragmentary view showing the end of a cross beam being hooked into the window opening in the main beam.

Creation of the joint utilizing the structure described above becomes simple and logical: Runners 11 are normally placed first, being suspended in position from ceiling wires engaging holes 54 (FIG. 1) in the web. With the parts in the relative positions shown in FIG. 7, that is, with the cross beam 20 oriented at right angles to the runner, the tongues 31, 32 are entered into the window 14 until the hook projection 50 thereon clears the window ledge following which the tongues are lowered into the seated position illustrated in FIG. 8. To facilitate the final movement of the cross beam into its seated position, it may be rocked upwardly into horizontal position, as shown in FIG. 7, or the main beam may be temporarily flexed, by fingertip pressure and to slight degree, about its axis out of its normal orientation. To reduce the need for the rocking or twisting action, the presented corner 55 (FIGS. 4 and 8) of the upper tongue may be rounded or chamfered slightly. Seating of the cross beam 21 causes the tongues 31, 32 to occupy diagonal corners of the window as illustrated in FIG. 9.

Figure 10:
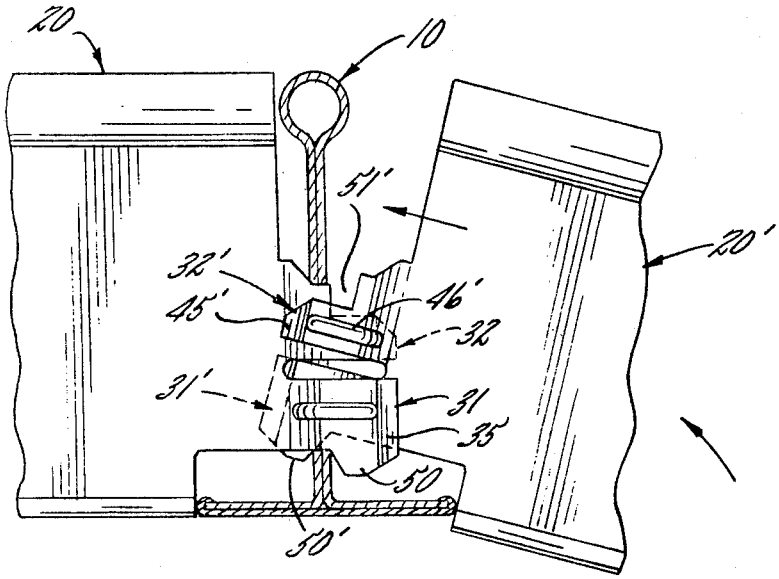
FIG. 10 shows the hooking of a companion cross member.
Figure 11:
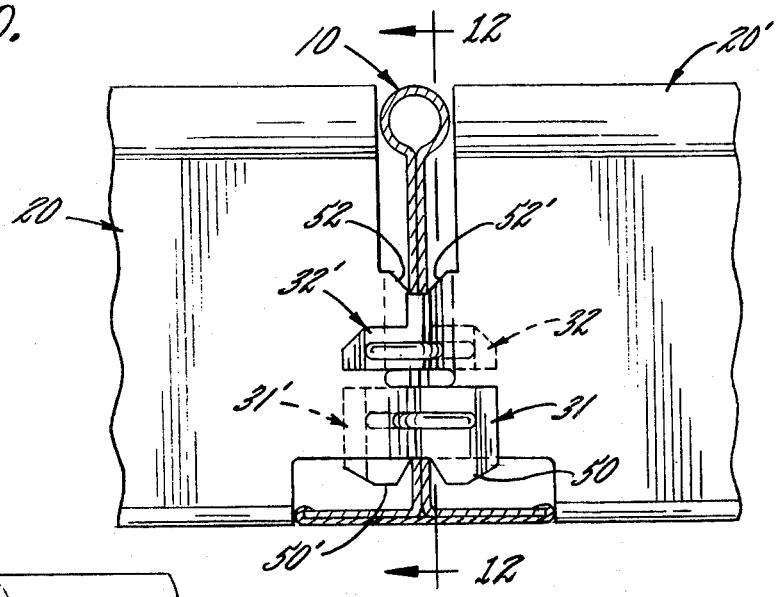
FIG. 11 shows the companion cross member in finally seated position.
Figure 12:
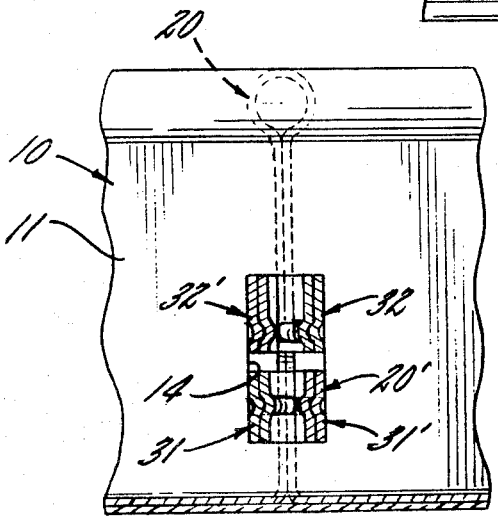
FIG. 12 is a fragmentary section taken along line 12—12 in FIG. 11.

Next the tongues of the right-hand cross member are inserted either with or without the accompanying rocking movement illustrated in FIG. 10, with final downward movement of the tongues into the seated position illustrated in FIGS. 11 and 12. In the latter figure it will be noted that the tongues 31', 32' of the cross member 20' occupy complementary positions, so that all four of the corners of the window are snugly occupied.

Figure 9:
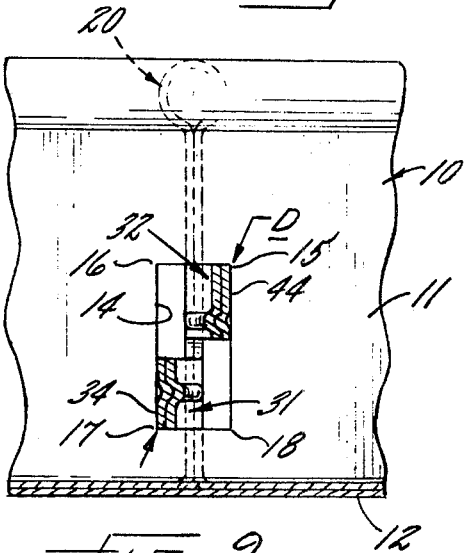
FIG. 9 is a fragmentary cross section taken along line 9—9 in FIG. 8.

Because of the diagonal offset of the tongues, and their outwardly sprung condition, the first cross member to be inserted, and which is illustrated in FIG. 9, is subject to a slight torsional twist, in the counterclockwise direction. However, when the second cross member is inserted, filling the remaining diagonal spaces in the window, the torsional forces neutralize one another and the two cross members, mated in abutting relation, become precisely positioned, with the flange on one of the members forming a smooth continuation of the flange on the other. Because of the tips of the tongues indicated at 35, 45 and 35', 45' are mutually inturned, insertion in the window becomes an easy matter and the bearing of the tips of the tongues of one of the cross members mutually inwardly upon the web of the other provides a high degree of stability while eliminating any possibility of looseness.

Figure 13:
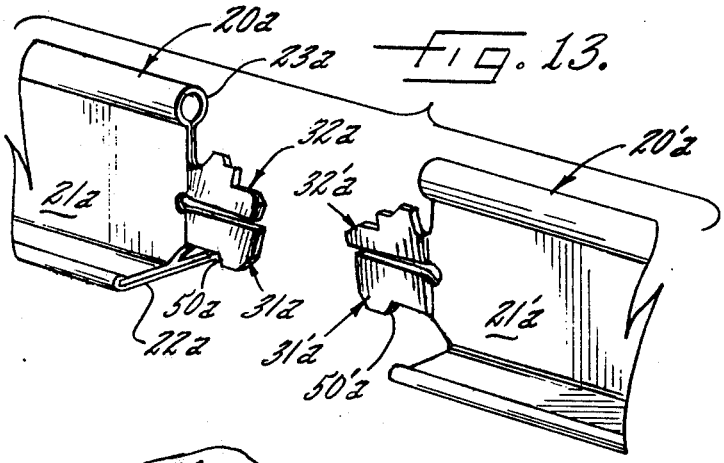
FIG. 13 shows a modified construction in which the tongues are twisted out of the plane of the associated web.
Figure 14:
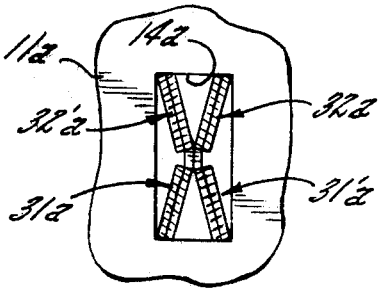
FIG. 14 is a sectional view at the window corresponding to FIG. 13.

In the preferred embodiment discussed above the central portion of each tongue is substantially parallel to the web of the associated cross beam. The invention also contemplates use of tongues which, instead of being maintained parallel to the web, are twisted in the same rotary direction so that the remote lower and upper edges of the respective pair of tongues extend in opposite directions out of the plane of the associated web of the cross beam with the result that the upper edge of the upper tongue and the lower edge of the lower tongue extended to snugly fitted diagonal positions in the window. Such a construction is shown in FIGS. 13 and 14 in which corresponding parts have been designated by corresponding reference numerals with addition of subscript a.

Figure 15:
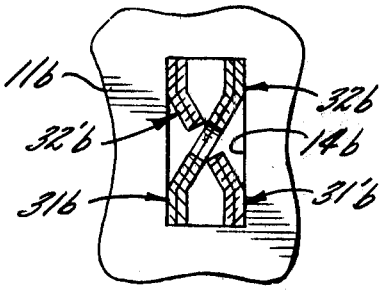
FIG. 15 shows a further embodiment employing tongues which are both twisted and creased.

As a further modification each tongue, in addition to being twisted out of the plane of the web, may be centrally and longitudinally creased to form a shallow obtuse angle in vertical section. This is shown in cross section in FIG. 15 where corresponding elements are indicated by corresponding reference numerals with addition of subscript b.

Figure 16:
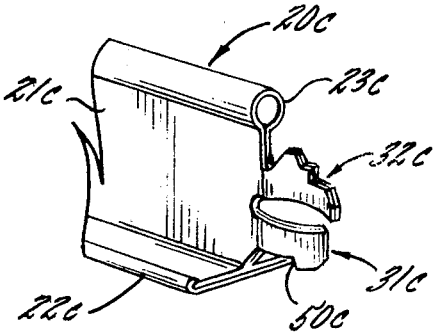
FIG. 16 shows a still further embodiment using tongues which are smoothly convex.
Figure 17:
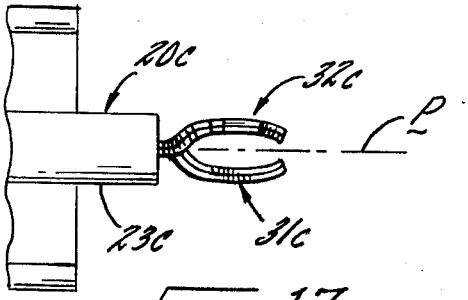
FIG. 17 is a top view showing the profile of the tongues of FIG. 16.

Finally, if desired, the three successive portions 33–35 of the lower tongue and 43–45 of the upper tongue may be merged into a single continuous arc, as viewed in plan profile, with concave sides facing inwardly toward, and spaced from, the plane P of the associated web. This is shown in FIGS. 16 and 17, where similar elements are indicated by similar reference numerals, but with addition of subscript c.

It is one of the features of the present construction that sharp detenting of the parts, with dependence upon the localized resilient characteristics of the metal is avoided. The parts slide together smoothly into their relative seated positions and do not snap together with abrupt detenting. As a result, there is a high uniformity of action from one joint to the next, and the installer is not at the mercy of variations in the resilience or dimensioning of sharply detended parts. It follows from this that the parts separate more readily by reversing the assembly procedure whenever disassembly may be required in the future.

It will be understood that the term "captive against longitudinal withdrawal" as used herein does not necessarily require that the cross beams are positively locked against longitudinal movement but that they are, at the least, inhibited, or resistant to, longitudinal withdrawal from their seated positions.

What I claim is:

1. In a suspended ceiling system the combination comprising a main beam having a vertical web and lower flange at right angles thereto the web having formed therein a vertically extending rectangular window, a pair of identical cross beams each having a vertical web and lower flange and intended to abut the main beam in alignment with one another at the window, each cross beam having a pair of longitudinally extending vertically spaced tongues integral with the web, the tongues being spaced and offset in opposite directions from the plane of the associated web to such degree that the diagonally measured distance between the upper edge of the upper tongue and the lower edge of the lower tongue is equal to the diagonal dimension of the window so that, when the tongues of the cross beams are inserted into the window from opposite sides to seated positions in which the flanges of the beams are in abutting relation, the tongues of the cross beams mutually overlap one another snugly occupying all four corners of the window opening, the lower tongues each being formed with an integral downwardly-extending hook projection which is in interfering engagement with the lower edge of the window thereby to make the cross beams in their seated positions effectively captive with the main beam against longitudinal withdrawal.

2. The combination as claimed in claim 1 in which the tips of the tongues are bent mutually inwardly to facilitate insertion of the tongues into the window and so that when the cross beams are in their seated positions the tips of the tongues of one cross beam are in opposed stabilizing engagement with the web of the companion cross beam.

3. The combination as claimed in claim 1 in which the distance, measured perpendicularly to the web, between the outwardly facing surfaces of the tongues is slightly greater than the width dimension of the window thereby to provide a resiliently interfering fit between the tongues and the edges of the window opening.

4. The combination as claimed in claim 1 in which the upper tongue of each cross beam is relieved at the tip of its upper edge to provide initial clearance with respect to the upper edge of the window to permit hooking of the hook projection on the cross beam over the lower edge of the window as a preliminary to movement into seated position therein.

5. The combination as claimed in claim 4 in which there is a stop surface at the base portion of the upper tongue which engages the upper edge of the window in the web of the main beam when the cross beam has been advanced to seated position.

6. The combination as claimed in claim 1 in which the tongues are of substantially the same length measured longitudinally of the cross beam but in which the tip portion of the upper tongue is of reduced width in the vertical direction to provide initial clearance with respect to the upper edge of the window to permit hooking of the hook projection on the lower tongue over the lower edge of the window as a preliminary to movement into seated position therein.

7. The combination as claimed in claim 2 in which the central portion of each tongue is substantially parallel to the web of the associated cross beam.

8. The combination as claimed in claim 1 in which the tongues are twisted in the same rotary direction so that the remote lower and upper edges of the respective pair of tongues extend in opposite directions out of the plane of the associated web occupying diagonal positions dimensioned for snug reception in the respective diagonal corners of the window opening.

9. The combination as claimed in claim 8 in which the tongues in addition to being twisted are longitudinally creased to form a shallow obtuse angle in vertical section.

10. The combination as claimed in claim 1 in which the tongues are arcuately bent in plan profile with the concave sides facing, and spaced from, the plane of the associated web.

* * * * *